US005381078A

United States Patent [19]

Szuba

[11] Patent Number: 5,381,078

[45] Date of Patent: Jan. 10, 1995

[54] CONTROL AND COMMUNICATION PROCESSOR POTENTIOMETER SYSTEM FOR CONTROLLING FLUORESCENT LAMPS

[75] Inventor: Stefan Szuba, Park Ridge, Ill.

[73] Assignee: North American Philips Corporation, New York, N.Y.

[21] Appl. No.: 31,440

[22] Filed: Mar. 15, 1993

[51] Int. Cl.[6] ..... H05B 37/00

[52] U.S. Cl. ..... 315/316; 315/324

[58] Field of Search ..... 315/313, 316, 324, 292

[56] References Cited

U.S. PATENT DOCUMENTS 4,792,731 12/1988 Pearlman et al. ..... 315/316
5,059,871 10/1991 Pearlman et al. ..... 315/316
5,196,782 3/1993 D'Aleo et al. ..... 315/291

*Primary Examiner*—Richard A. Bertsch
*Assistant Examiner*—Peter Korytnyk
*Attorney, Agent, or Firm*—Paul R. Miller

[57] ABSTRACT

A wall-mounted electronic potentiometer system is provided for controlling fluorescent lamps by way of ceiling mounted controllers. This enables control of the control information by way of a 2-wire communication bus to selected ceiling mounted controller using a serial data format.

3 Claims, 5 Drawing Sheets

CONTROL AND COMMUNICATION PROCESSOR POTENTIOMETER SYSTEM FOR CONTROLLING FLUORESCENT LAMPS

The present invention is directed to an electronic potentiometer system for controlling fluorescent lamps. More particularly, the present invention involves a network of electronic potentiometers controlling at least one electronic controller which controls a ballast of fluorescent lamps where a two wire communication bus connects the network of electronic potentiometers to the electronic controllers.

BACKGROUND OF THE INVENTION

Lighting control of ceiling mounted fluorescent lamps together with light dimming systems have been variously seen in the prior art, such in U.S. Pat. No. 3,697,821. In this previous arrangement, semiconductor multiple remote control units have been used to switch and dim lights. A remote control unit is provided for individually and independently controlling the operation of a common lamp dimmer unit by turning on and off the dimmer unit and controlling the brightness of the lamps independently of previous settings or conditions of the remote control units. A three wire conductor system is utilized to connect various remote control units in parallel with one another.

In U.S. Pat. 4,733,138 a programmable lighting circuit controller for controlling a plurality of household lighting circuits includes a microprocessor and an electronically erasable programmable read-only memory for programming household lighting circuits for a variety of loads. One of the lighting circuits may include fluorescent loads by using a heater circuit for the fluorescent lamps. The microprocessor is controlled to raise and lower lighting levels, set lighting levels in memory and recall preset levels from memory, as well as to provide heating for the fluorescent lights.

This arrangement provides a multi-gain wall-mounted lighting circuit controller which may be programmed to control both heating circuits and fluorescent light circuits by appropriate control of the microprocessor. This prior arrangement enables computer control of various combinations of lighting levels and functions to differing configurations depending on whether incandescent lighting or fluorescent lighting is to be used.

Both of these prior schemes for controlling lighting circuits, and in particular fluorescent lighting circuits, fail to provide a control system of connected electronic potentiometer wall units providing control from many different positions using optimum wiring for operation of both the entire lighting system and portions of lighting system.

SUMMARY OF THE INVENTION

The present invention, on the other hand, does provide an electronic potentiometer system for controlling fluorescent lamps from many different positions using a 2-wire bus for operating the entire lighting arrangement. In particular, a network of wall-mounted electronic potentiometers is provided for controlling a plurality of electronic controllers which control the ballast of fluorescent lamps.

The present invention contemplates any practical number of wall-mounted electronic potentiometers to be used in the system. For example, four such wall-mounted electronic Potentiometers might be utilized.

Each electronic potentiometer includes a local microprocessor-based controller with a communications media transceiver which are controlled by a keypad enabling the user to select various operations and functions. The local microprocessor-based controller with the communications media transceiver may be a 3150 NEURON-chip with a transformer-isolated 78 kbps transceiver available from ECHELON Corp. Alternatively, MC143150 and MC143120 NEURON-chip distributed communications and control processors are available from Motorola. Thus, both ON and OFF functions, as well as variations in the lighting level to be achieved can be enabled. Each of the functions can be stopped and various preset levels can be formulated with storage of these levels.

Any practical number of ceiling mounted controller units may be utilized in the system so that any installation size can be implemented. The present invention contemplates ceiling mounted controller units being built around such local microprocessor-based controllers with communications media transceivers, D/A and A/D converters, and ballast dimming module drivers with mains on and off switches. By this circuitry, digitized output of local microprocessor-based controllers can be converted into analog voltage signals which are applied through a control bus to the ballasts to control the light output of the entire installation, as well as parts thereof. If required, control of the mains on and off switch is also achieved.

The dimming module operating voltage, i.e., the voltage at ballast dimming input, is A/D converted and passed through a 2-wire communication bus back to the wall-mounted electronic potentiometers for indicating actual light output on LED bar displays.

The 2-wire communication bus passes the control information updates from the electronic potentiometers to selected blocks of ceiling mounted controllers using serial data format. The communication bus may be formed as a twisted-pair link or existing AC mains wiring can be used.

The operation of the wall-mounted potentiometers and the ceiling mounted controllers through the 2-wire communication bus is under control of software stored in the memory of the local processors of each physical block of this system. This software can control the electronic potentiometer by scanning keypad outputs to determine whether any key is pressed. If a key is pressed, an electrical value corresponding to the selected key is output through the communication bus to the ceiling mounted ballast controller. If a key is not pressed, then the program looks for the occurrence of display data updates, and if they are found, the data received through the communications bus is output to LED bar display drivers. After completion, the program loops back to the origin.

The ceiling mounted controller is also run on software so that the program looks for data updates from the keypad, and if it finds any, then corresponding control action is defined by an output to a D/A converter providing an analog DC voltage to control ballast. Next, A/D conversion of the actual ballast control voltage is performed and output through the 2-wire communication bus back to the electronic potentiometer in order to control a LED bar display driver. The software loops back to the origin after the completing the program.

BRIEF DESCRIPTION OF DRAWING FIGURES

The present invention will be described by reference to the drawing figures in which:

FIG. 1 schematically illustrates in block diagram form a portion of the hardware of the present invention;

DESCRIPTION OF THE INVENTION

Figure 1:
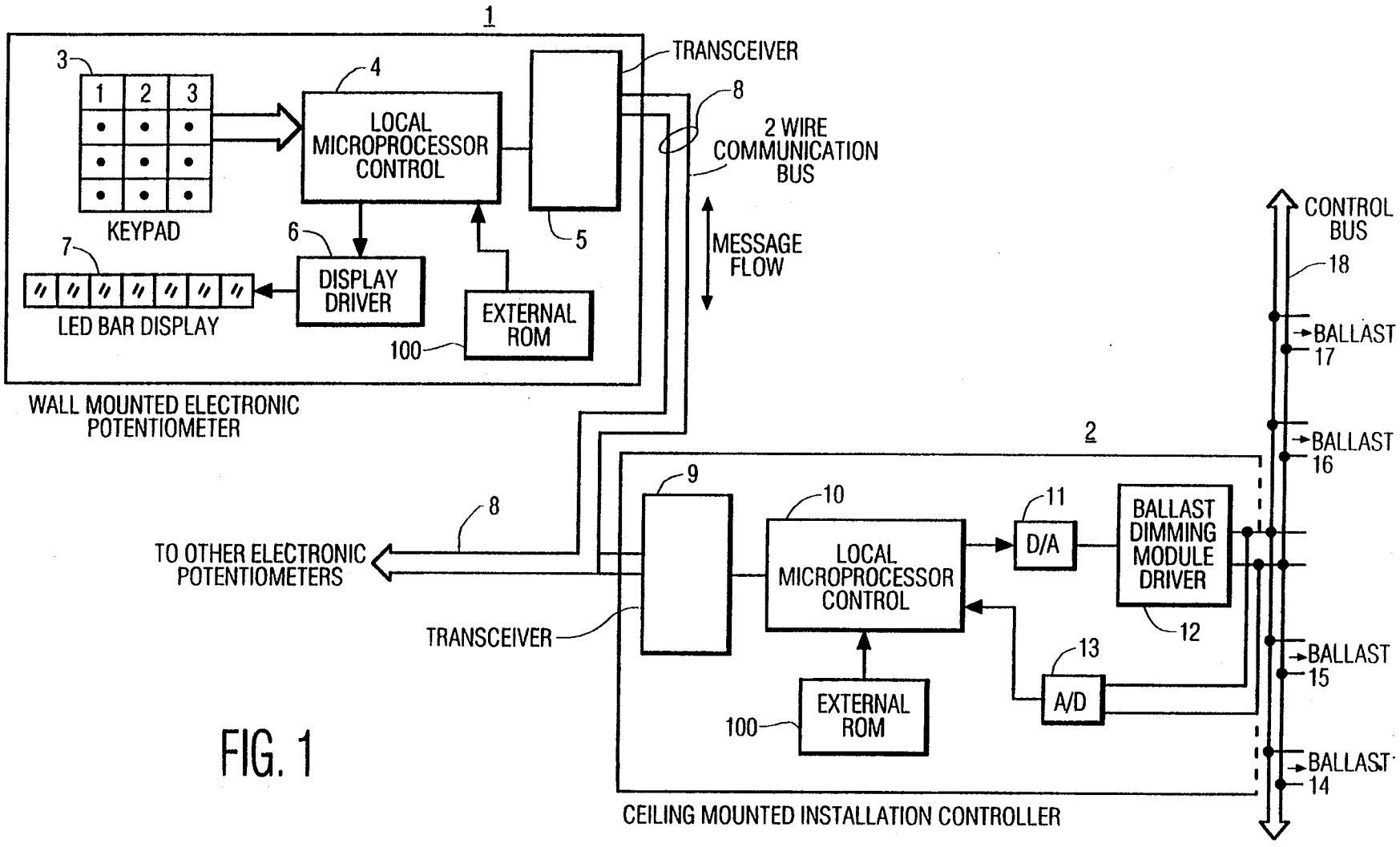

FIG. 1 shows in schematic block diagram form a portion of the system of the present invention. Namely, at least one wall-mounted electronic potentiometer 1 is provided with a keypad 3, a local microprocessor-based controller 4, such as a 3150 NEURON-chip with external read only memory 100 storing system image, transceiver 5, a display driver 6 and a 10 element LED bar display 7. The wall-mounted electronic potentiometer 1 is connected by way of a 2-wire communication bus 8 to at least one ceiling-mounted installation controller 2.

Figure 2A:
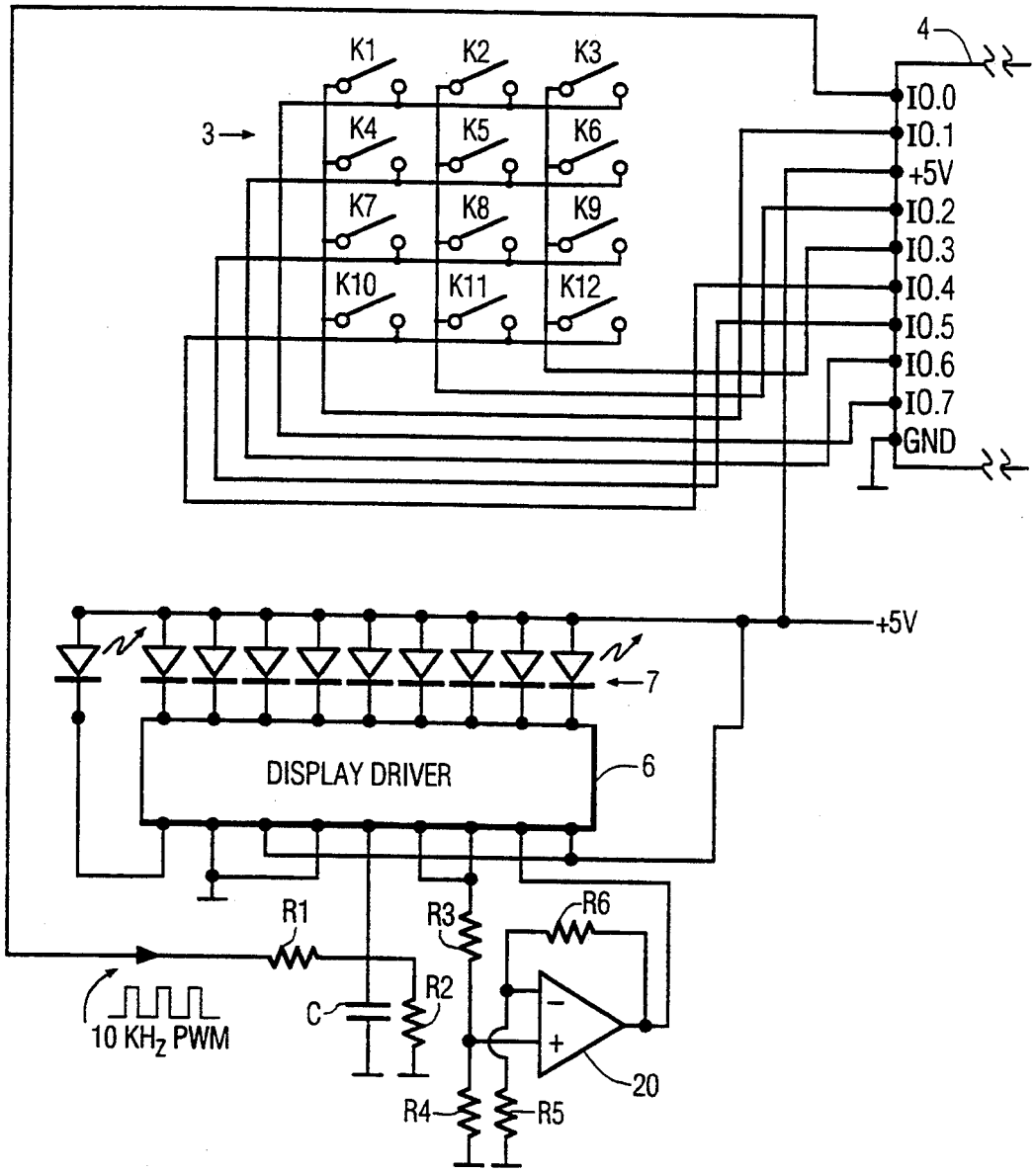
FIGS. 2A and 2B are schematic circuit diagrams of circuitry used in FIG. 1.

The keypad 3 is a twelve key device shown schematically by keys K1–K12 in FIG. 2A. The keys of this keypad are connected to I/O ports of the local microprocessor-based based controller 4. These I/O ports monitor the keypad status in order to sense any keypressed event, process the event accordingly, and then send a network message from communication transceiver 5 to any ceiling-mounted installation controllers, such as controller 2 by the 2 wire communication bus 8.

The network message contains the code number of the key that is pressed. At the ceiling-mounted controller 2, the message is decoded and predefined light output regulation occurs. In turn the ceiling-mounted controller 2 generates messages containing light output data for display on the LED bars, such as LED bar 7 in the electronic potentiometer 1.

The light output message is converted to a 10 kHz PWM waveform upon reaching the electronic potentiometer and output at an I/O port of the local microprocessor-based controller 4. The 10 kHz waveform is DC filtered by $R_1$, $R_2$ and C filters, and the resulting DC level, which is proportional to light output or power consumption, is fed to LED bar display driver 6, which may be a solid state circuit, such as National Semiconductor LM 3914, feeding the LED bar 7. The display driver 6 controls LED's, such as LED bar 7, such that the height of the bar graph, i.e., the number of LED's that are ON, is proportional to light output of the ceiling lamps or power consumed by the installation. The bar graph is a kind of user interface since it may help scheduling of maintenance, etc. The op-amp 20 and resistor network $R_4$ through $R_6$ stabilize current drawn by the LED's forming the bar graph.

The 2-wire communication bus 8 provides a message flow of information from the potentiometer to the ceiling-mounted controller 2 to direct information to various fluorescent lamp ballasts 14, 15, 16, and 17 along a control bus 18. The information from the wall-mounted electronic potentiometer 1 may be directed to the indicated ceiling mounted installation controller 2, or various other similar ceiling mounted installation controllers.

In a large area having a number of ceiling mounted fluorescent lamps, any practical number of wall-mounted electronic potentiometers may be used in the system for control of these fluorescent lamps. An example of such number is four.

Each wall-mounted electronic potentiometer, such as that seen in block 1 including local microprocessor-based controller 4, communications media transceiver 5, and keypad 3 enables the user to select various functions, such as the following: an OFF function button is provided to switch the installation OFF; an ON and MAXIMUM button may switch the installation on and the lighting level is switched to a maximum value; a DOWN and MINIMUM button causes the lighting level to decrease slowly to a minimum level, such as 20% of the maximum; a DOWN and OFF button will decrease the level slowly to the minimum level and then the installation is switched off; an ON and UP button causes the installation to be switched on and the lighting level increased slowly to the maximum level; a STOP button stops the fading up or down as described previously relative to the ON and MAXIMUM and DOWN and MINIMUM buttons, for example; various PRESET 1 through PRESET 4 buttons may be provided to enable a user to switch the installation on and a lighting level can be switched to one of four preset levels; and a STORE button allows the user to store the preset light levels in memory.

The display driver 6, provided with the LED bar display 7, displays a particular operating light level that has been selected. The LED bar display can then indicate the actual light output provided by the ceiling fluorescent lamps as a result of control by a ceiling-mounted installation controller, such as the controller 2. Such a ceiling-mounted controller 2 may be provided in any practical number according to the installation size of the lighting to be undertaken. One can implement any installation size according to an appropriate number of wall-mounted electronic potentiometers and ceiling-mounted controller units.

The ceiling-mounted controller unit 2 includes a local microprocessor-based controller 10 using the 3150 NEURON chip described above with external ROM 100 storing system image and a communications media transceiver 9, also similar to that described above. Information from these circuits is provided through a digital-to-analog converter 11 through a ballast dimming module driver 12 having a mains on/off switch. The digitized output of the local microprocessor-based controller 10 is converted to an analog voltage signal by which the ballast dimming module driver controls the light output of the entire installation, as well as the mains on/off switch, if required.

The dimming module operating voltage received from the ballasts, i e., the ballast voltage dimming input, is analog/digital converted by the A/D converter 13, and then sent by the transceiver 9 through the 2-wire communication bus 8 to a wall-mounted electronic potentiometer, such as potentiometer 1 in FIG. 1. This message flow back from the ceiling mounted controller to the wall-mounted electronic potentiometer provides an indication of the actual light output or power consumption by the LED bar display. The 2-wire communication bus 8 passes the control information updates from the wall-mounted electronic potentiometer to selected ceiling mounted controllers by way of a serial data format, such as a LONTALK protocol available from ECHELON Corp. The 2-wire communication bus 8 may be implemented as a twisted-pair link or may be implemented by use of existing AC mains wiring.

Figure 3:
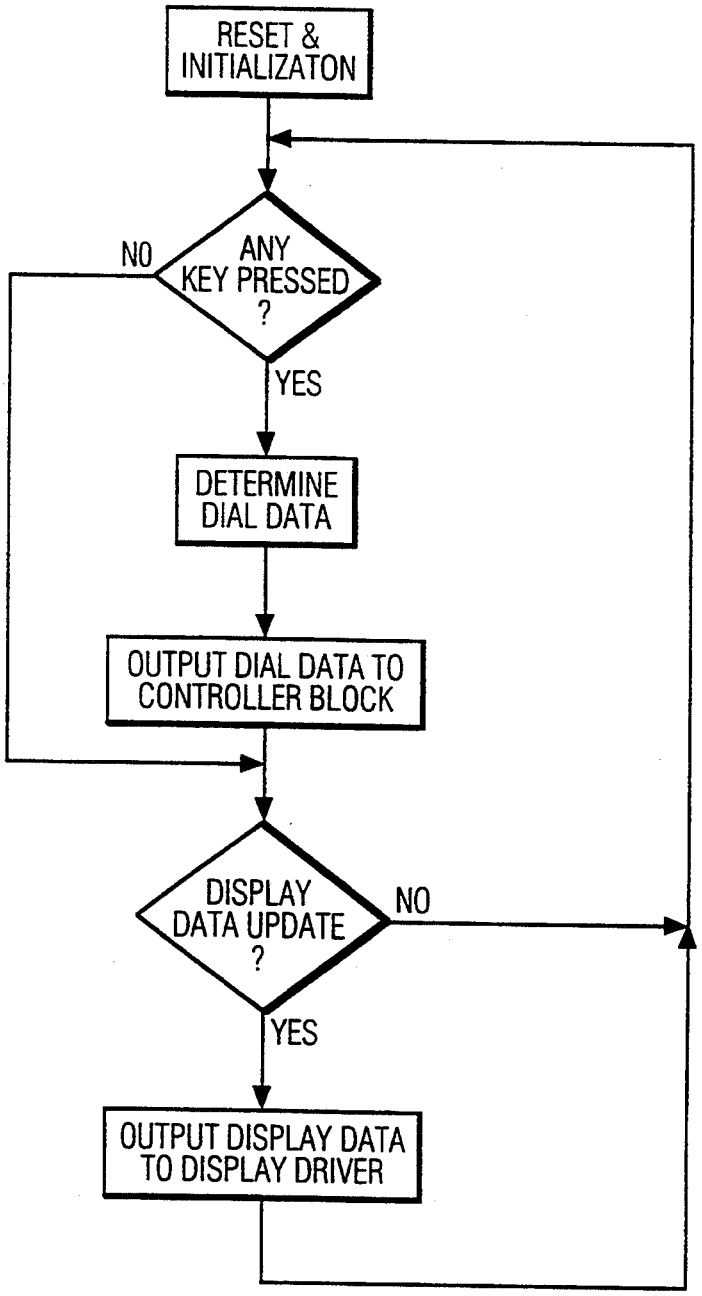
FIG. 3 illustrates the flow chart for operation of the electronic potentiometer in FIG. 1.

The operation of the wall-mounted electronic potentiometers and the ceiling mounted controllers, as well as the communications buses 8 and 18, is under control of software stored in the memory of the local controllers 4 and 10, for example, of each physical block of the system. The software for the electronic potentiometer operates according to the flow chart seen in FIG. 3.

In this respect, after reset and initialization of the electronic potentiometer hardware, the software scans the keypad outputs to find out whether any key is pressed. If so, the electrical value, or dial value, corresponding to the key selected is output through the communications bus 8 to the ceiling mounted controller 2. If a key is not pressed, then the program looks for a display data update occurrence, and if this is found, the data received through the communications bus 2 is output to the LED bar display driver 6. After completion of the output display data to the display driver, the program loops back to the origin.

Figure 4:
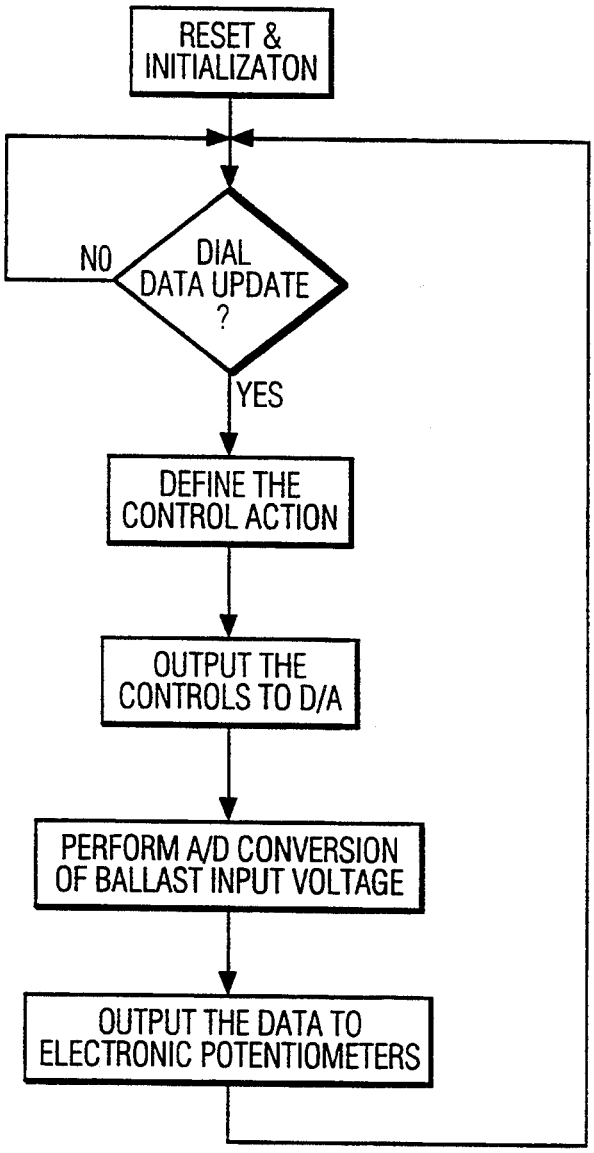
FIG. 4 illustrates the flow chart for operation of the ceiling mounted controller in FIG. 1.

FIG. 4 illustrates by way of a flow chart the operation of software running in the ceiling mounting controller, such as the controller 2. After reset and initialization of the relevant hardware, if necessary, the program looks for electrical value, or dial, data updates, and if it finds any, then corresponding control action is defined and output to the D/A converter 11 whose output is analog DC voltage controlling the ballast. Next, A/D conversion of the actual ballast control voltage is performed by the A/D converter 13 and output through the communications bus 8 back to an electronic potentiometer, such as the electronic potentiometer 1, to control the LED bar display driver, such as the driver 6 in FIG. 1. The software then loops back to the origin as shown in FIG. 4.

Figure 2B:
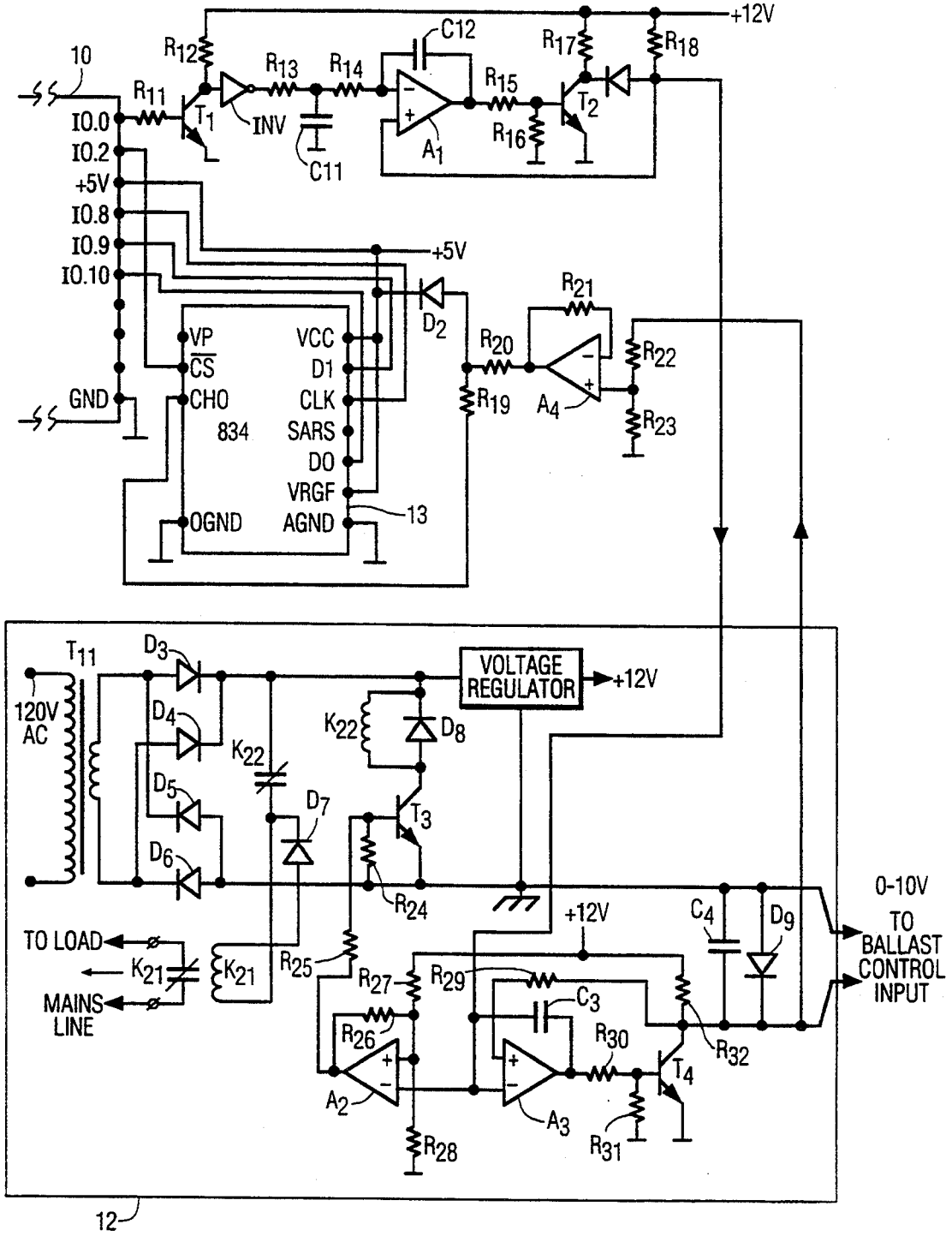

The present invention operates according to FIG. 2B in which a code corresponding to a key-pressed event at the wall mounted electronic potentiometer is output on the network and received by the transceiver 9 and local microprocessor-based controller 10 on the ceiling-mounted installation controller 2. Software operating on each controller 10 decodes the received code and converts it to a 10 kHz PWM waveform which in turn is output from an I/O port of the NEURON chip of controller 10. The waveform is approximately 5 volt amplitude and has to be level shifted in order to match the operating range of ballast dimming control inputs, i.e., 0–10 volts DC. The level shifting is accomplished by resistors $R_{11}$ and $R_{12}$, transistor $T_1$ and inverter INV.

Next the waveform so obtained is DC filtered by resistors $R_{13}$, $R_{14}$ and capacitor C,, and output buffered by amplifier A1, resistors $R_{15}$–$R_{18}$, rectifier $D_{11}$ and capacitor 12. The resulting De voltage controls the ballast dimming module driver 12 which includes transformer $T_{11}$ and full-wave rectifiers $D_3$–$D_6$ which provide power to operate the relays $K_{21}$ and $K_{22}$ as well as the rest of the electronic circuitry built around comparator A2 and amplifier-buffer A3.

When DC voltage arrives at inverting inputs of comparator A2 and amplifier-buffer A3, the following control takes place.

1. If the DC voltage is in the range 0–0.4 V, then the comparator A2, resistors $R_{26}$, $R_{27}$ and $R_{28}$ turns off transistor $T_3$, and this in turn removes power from relays $K_{21}$ and $K_{22}$ which means that relay $K_{22}$ opens and the lighting installation under control (ballasts) turns off.

2. If the DC voltage is in the range 0.7 v to 10 v, then comparator A2 turns on relays $K_{21}$ and $K_{22}$, and this in turn switches the lighting installation ON, and the light output of the ballasts under control is defined by the voltage output of amplifier-buffer $A_3$, resistors $R_{29}$, $R_{30}$, $R_{31}$ and $R_{32}$, transistor $T_4$, capacitors C3 and C4, and zener diode D9 to the ballast dimming control inputs (0–10 volts).

The DC voltage operating the ballast dimming inputs is an approximate measure of illuminance level or power consumption. This may be used as a kind of user interface or used for maintenance. Hence the operating voltage level is fed to buffer A4 and.interfaced to channel CHO of A/D converter 13. The timing and control of the A/D operation is under software control of local microprocessor-based controller 10. It is this interface which converts DC voltage operating at ballast dimming inputs to a digital format which is input at an I/O pin of the local microprocessor-based controller 10. This digital representation of the light level is further converted to a network message by the operating software which is sent back to the wall-mounted electronic potentiometers for LED bar graph display.

While there exist pushbutton wall-mounted controllers in fluorescent lighting systems, such arrangements do not use a serial data transmission format, as occurs by the present invention. Consequently, a significant amount of wiring has been previously required to implement the function, i.e., more than ten wires have to be run between units. Secondly, there is no user-presettable light outputs because previous systems have no electronic memory, as occurs in the present application.

Consequently, by the arrangement of the present invention, a control system of connected in parallel electronic potentiometers can be provided so that the lighting can be controlled from many different positions using an optimum wiring, such as that required for operation of the whole lighting system.

What I claim:

1. A system for controlling a plurality of ceiling mounted fluorescent lamps comprising (a) at least one electronic potentiometer means disposed on a wall for adjusting light levels of a plurality of fluorescent lamps disposed on a ceiling, said at least one electronic potentiometer means including a local operating network system;

(b) at least one electronic controller means disposed on said ceiling for controlling ballasts of said fluorescent lamps, said at least one electronic controller means also including a local operating network system; and (c) a 2-wire communication bus connecting said at least one electronic potentiometer means to said at least one electronic controller means.

2. A system according to claim 1, wherein said at least one electronic potentiometer means includes an electronic key-pad, local microprocessor control circuitry providing said local operating network system, transceiver means for sending electrical signals to said at least one electronic controller means, and an LED display means, and wherein said at least one electronic controller means includes second transceiver means for receiving and sending data from said fluorescent lamps to said electronic potentiometer means, second local microprocessor control circuitry providing said local operating network system, D/A converter circuits, and a ballast driver circuit.

3. A system according to claim 2, wherein said first and second local processor controls circuitry and said first and second transceiver means are provided by a NEURON-type chip.

* * * * *